United States Patent [19]

Hirosawa et al.

[11] 4,027,640

[45] June 7, 1977

[54] AUTOMATIC CHOKE VALVE APPARATUS IN AN INTERNAL COMBUSTION ENGINE

[75] Inventors: Yoshiaki Hirosawa, Tokyo; Toshio Nomura, Niiza; Masahiko Iiyama, Tokyo, all of Japan

[73] Assignee: Honda Giken Kogyo Kabushiki Kaisha, Tokyo, Japan

[22] Filed: Aug. 15, 1975

[21] Appl. No.: 606,403

[52] U.S. Cl. ..... 123/179 G; 123/119 F; 261/39 E; 261/64 R

[51] Int. Cl.[2] ..... F02M 1/10; F02D 11/08

[58] Field of Search ..... 123/179 G, 119 F, 179 R; 261/39 E, 39 B, 64 R

[56] References Cited

UNITED STATES PATENTS

| | | | |
|---|---|---|---|
| 3,401,919 | 9/1968 | Seufert | 261/64 R |
| 3,534,720 | 10/1970 | Dubois | 123/119 F |
| 3,818,881 | 6/1974 | Hosho | 123/119 F |
| 3,948,240 | 4/1976 | Hirosawa | 123/119 F |

*Primary Examiner*—Carroll B. Dority, Jr.
*Assistant Examiner*—Daniel J. O'Connor

[57] ABSTRACT

An automatic choke valve apparatus in an internal combustion engine in which an operation shaft connected to a choke valve provided in an intake passage of an internal combustion engine and a driving shaft connected to a pulse motor are interconnected through an intermediate torsion spring and are engaged with one another through circumferentially disposed front and rear pawls for being feed-driven only in a regular direction of rotation of the driving shaft. By effecting reverse direction of rotation of the driving shaft and then regular direction of rotation of, the choke valve is first placed into a starting position setting and then into an open-degree position after engine firing is carried out by the pulse motor effecting rotation in the regular direction for a length of time and at a speed both depending on engine temperature.

6 Claims, 4 Drawing Figures

AUTOMATIC CHOKE VALVE APPARATUS IN AN INTERNAL COMBUSTION ENGINE

CROSS-RELATED APPLICATION

This Application is related in subject matter to U.S. application Ser. No. 558,714, filed Mar. 14, 1975 and incorporates the contents thereof hereinto by way of reference.

FIELD OF THE INVENTION

This invention relates to an automatic choke valve apparatus in an internal combustion engine for a motorcar or the like.

BACKGROUND

The applicants have previously proposed choke valve apparatus in which an operation shaft connected to a choke valve provided in an intake passage of an internal combustion engine and a driving shaft connected to a pulse motor are interconnected through an intermediate torsion spring and are engaged with another through circumferentially disposed front and rear pawls for being feed-driven only in a regular direction of rotation of the driving shaft, the arrangement being such that, by imparting a reverse direction of rotation and then a regular direction of rotation from the pulse motor, the choke valve is given an initial standard position setting, then a starting position setting, then an open-degree position after completed engine firing is carried out by a regular direction of rotation of the motor at a predetermined high speed and for a fixed length of time. With this arrangement, however, there is the deficiency that because the choke valve is always driven at a fixed speed to the open degree position, delay in fuel supply may arise especially upon engine starting at low temperature. Accordingly the engine operation may not be smooth and may be unstable and lead to engine stalling.

SUMMARY OF THE INVENTION

An object of the invention is to provide an apparatus of the above type which is free from such a defect.

Another object of the invention is to provide such apparatus of the above type in which the choke valve is driven by the pulse motor from the starting position to the open-degree position after completed engine firing in a time period and at a rate of speed which is dependent on engine temperature.

In accordance with the invention, in an automatic choke valve apparatus of the type in which an operation shaft connected to a choke valve provided in an intake passage of an internal combustion engine and a driving shaft connected to a pulse motor are interconnected through an intermediate torsion spring and are engaged one with another through circumferentially disposed front and rear pawls for being feed-driven only in a regular direction of rotation of the driving shaft so that, by reverse direction of rotation of the driving shaft and subsequent regular direction of rotation of the driving shaft caused by the motor, the choke valve will be given a starting position setting and then an open-degree position setting after completed engine firing, the improvement being that the opening direction of rotation of the choke valve to the open degree position is carried out in the regular direction of rotation by the pulse motor over a time interval and at a speed both depending on engine temperature.

DETAILED DESCRIPTION

Figure 1:
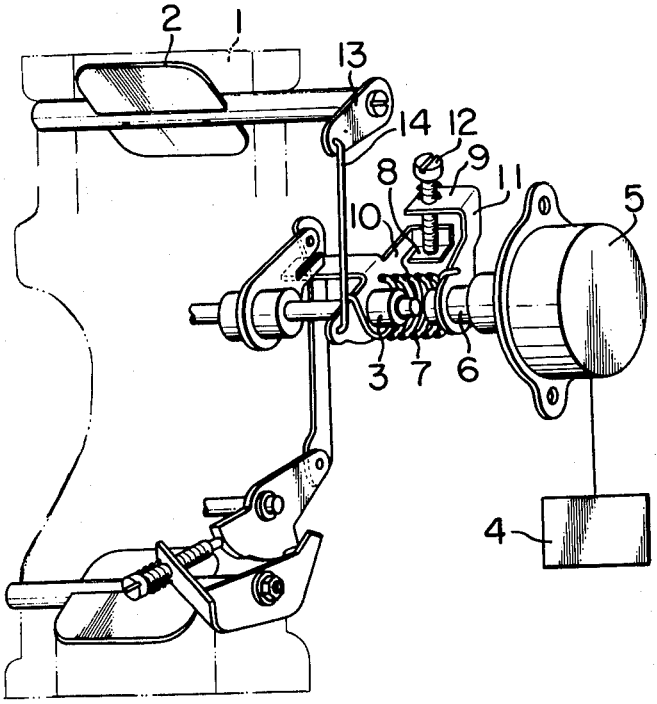
FIG. 1 is a perspective view of one embodiment according to this invention.

Referring to the drawings, numeral 1 denotes an intake passage of an internal combustion engine, numeral 2 denotes a choke valve mounted therein and numeral 3 denotes an operation shaft connected thereto. A pulse motor 5 is connected to a driving pulse circuit 4 and an operation shaft 6 is connected to the motor 5. The operation shaft 3 and the driving shaft 6 are interconnected through an intermediate torsion spring 7 and the shafts are engaged with one another through circumferentially disposed front and rear pawls 8,9 for being feed-driven only in a regular direction of rotation of the driving shaft 6, i.e. clockwise. In the illustrated embodiment, the operation shaft 3 and the driving shaft 6 have respective side arms 10,11 projecting radially thereof and respective ends of the side arms are formed as the foregoing pawls 8,9. Pawl 9 is provided with an adjustable screw 12 so that the engaging point between the two pawls 8,9 may be adjusted thereby. Additionally, the choke valve 2 is connected at its outer end by a choke lever 13 to a base portion of the side arm 10 through a rod 14.

The driving pulse circuit 4 is so contructed that upon detection in sequence of the closure of an ignition switch, the closure of a starter switch, the beginning of completed engine firing and the continuance of engine firing, the pulse circuit is changed over between first to fourth operation conditions in such a manner that in the first operation condition the motor 5, and accordingly, the driving shaft 6 is driven in reverse direction of rotation i.e. in counterclockwise direction in the drawing and in the second to fourth operation conditions the shaft 6 is driven in sequential clockwise regular direction of rotation. By such reverse direction and regular direction of rotation, the driving shaft 6 is moved from a point A to a point B as shown in FIG. 2 for imparting to the choke valve 2 the standard position setting, thereafter the valve 2 is moved from a point C to a point D for attaining the starting position setting, and then the valve 2 is moved from a point E to a point F for the open-degree firing position setting, and finally the valve 2 is moved from point F to a point G for the control operation setting.

At the starting position, the choke valve 2 is in a fully closed position and a resilient force corresponding to engine temperature acts on valve 2 by the torsion spring 7 to urge the valve 2 to closed position. If the engine is then started, the motor 5, and accordingly, the driving shaft 6 is rotated through a predetermined angle in the regular direction of rotation, so that the valve 2 is brought into the open-degree position of completed engine firing. The above is the same as the operation as our application Ser. No. 558,714 and therefore no further detailed explanation is given here.

Figure 2:
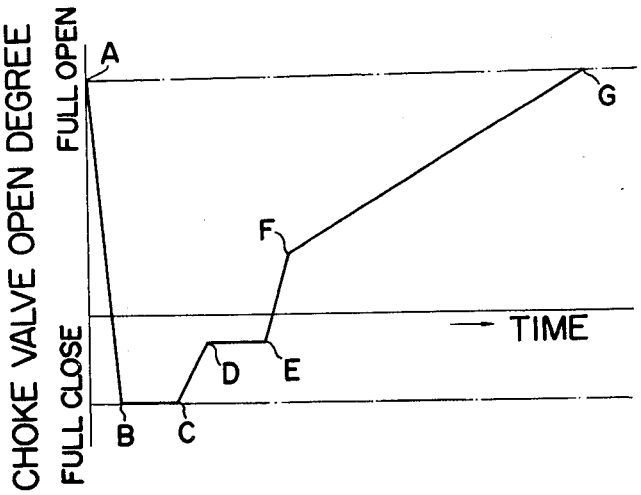
FIG. 2 is a graph for explanation of the operation thereof.

In the said previous Application, the movement from the starting position setting to the open-degree position after completed firing, that is, the movement from the point E to the point F in FIG. 2 is carried out by rotation of motor 5 at a fixed high speed and fixed time interval in the regular direction of rotation of the motor 5. Accordingly, the driving shaft 6 follows the motor 5 and therefore there is brought about such disadvantages as mentioned before.

The invention seeks to overcome this. According to this invention, this operation is carried out by a regular direction of rotation of the pulse motor, and accordingly, the driving shaft 6, at a speed and for a length of time which correspond to engine temperature.

Figure 3:
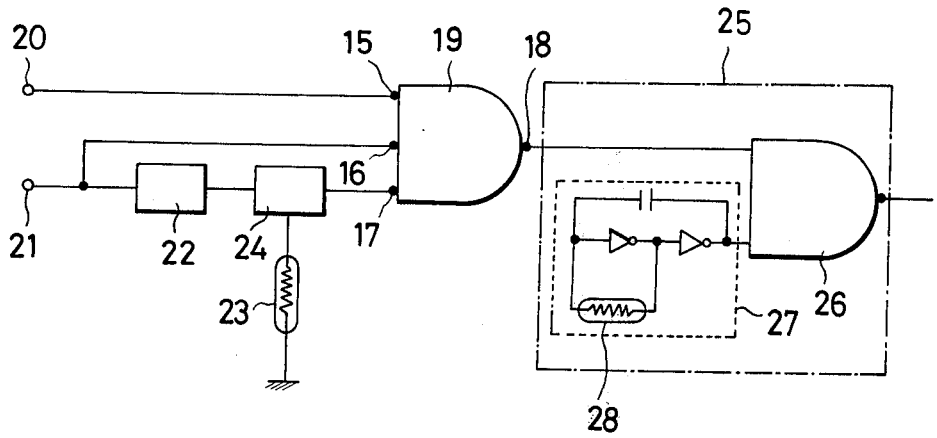
FIG. 3 is a circuit diagram of a significant portion of the embodiment.

FIG. 3 shows a circuit for achieving this operation. Namely the circuit comprises an AND circuit 19 having first, second and third input terminals 15,16,17 and a single output terminal 18. A first detection circuit 20 which operates in response to closure of the ignition switch is connected to the first input terminal 15, and a second detection circuit 21 which operates in response to the beginning of completed engine firing is connected to the second and the third input terminals 16,17 through two connecting circuits in parallel with one another. Interposed in one of the connecting circuits, in series with one another are a differential circuit 22 and a timer 24 having a variable resistor 23 sensitive to engine temperature. A control circuit 25 for controlling the operation of the driving pulse circuit 4 is connected to the output terminal 18 of the AND circuit 19. The control circuit 25 is so constructed that by operation thereof the driving pulse circuit 4 is set to operate with an output frequency corresponding to engine temperature. The rate of speed of driving shaft 6 by motor 5 is dependent on the output frequency of pulse motor 4.

Figure 4:
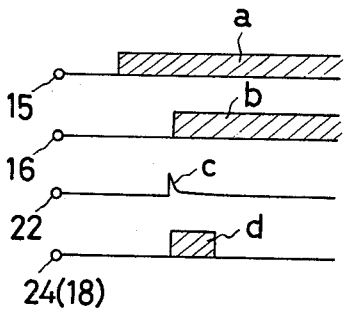
FIG. 4 is a waveform diagram for explanation of the operation thereof.

As shown in FIG. 3, the control circuit 25 comprises an AND circuit 26 and a driving pulse oscillator 27 connected, in parallel with the AND circuit 19, to the input side thereof. The oscillator 27 is provided with a variable resistor 28 sensitive to engine temperature so that the output signal thereof is at a frequency corresponding to engine temperature. Thus, an output signal which corresponds in frequency and in time length to engine temperature is obtained at the output side of the AND circuit 26 for being supplied to the pulse motor 5. Thus, when detection signals are produced in sequence in the first and second detection circuits 20,21 by the closure of the ignition switch and the beginning of engine firing, waveforms *a,b,c* as shown in FIG. 4 are produced. Waveforms *a* and *b* are respectively applied to the first input terminal 15 and the second input terminal 16 and waveform *c* is the output pulse of the differential circuit 22. Waveform *d* as shown in FIG. 4 is taken out as an output terminal 18 of the AND circuit 19. This waveform *d* starts simultaneously with the beginning of the engine firing and is kept for a time length set by the timer 24, this length of time being automatically set to correspond to engine temperature by reason of the variable resistor 23 of the timer 24. Hence, the output waveform *d* of a length of time corresponding to the engine temperature can be obtained at the output side of the AND circuit 19. This waveform *d* serves to determine the operation time length of the next stage control circuit 25, and as mentioned before, this circuit 25 is of the type in which the driving pulse circuit 4 is controlled in operation to have an output frequency corresponding to the engine temperature. Thus, the circuit 4 produces an output pulse signal of a frequcney corresponding to the engine temperature for a length of time corresponding to the engine temperature. In other words, the motor 5, and accordingly, the driving shaft 6 rotates in the regular direction at a speed corresponding to the engine temperature. Therefore, at a comparatively low temperature, shaft 6 rotates in the regular direction at comparatively low speed for a comparatively long length of time, and at a comparatively high temperature it rotates at a comparatively high speed for a comparatively short length of time. Thereby a straight line connecting the points EF in FIG. 2 is changed over between a comparatively gentle gradient and a comparatively steep gradient according to engine temperature. Thus, according to this invention, the arrangement is such that the movement from the starting position to the open-degree firing position is effected by a regular direction of rotation of the pulse motor, and accordingly, of the driving shaft connected thereto at a speed and for a length of time depending on engine temperature, so that the choke valve can be given a comparatively low speed and comparatively long length of time open valve operation at relatively low engine temperature and high speed and comparatively short length of time open valve operation at a comparatively high engine temperature. Thus unstable engine operation liable to be caused in the case of open valve operation of a fixed time and a comparatively high speed regardless of temperature can be removed.

What is claimed is:

1. An automatic choke valve apparatus for an internal combustion engine comprising a choke valve mounted in an intake passage of an internal combustion engine, an operation shaft connected to said choke valve, an external pulse motor including a drive shaft, an intermediate torsion spring connecting said operation shaft and said drive shaft, coupling means between said shafts for imparting drive from said drive shaft to said operation shaft only in regular direction of rotation of the drive shaft, and a driving pulse circuit means connected to said pulse motor for driving the same from a position for engine starting to a position when engine firing is completed, said driving pulse circuit means comprising an electrical circuit having a first input sensitive to closure of an ignition switch, a second input sensitive to the beginning of completed engine firing, variable resistor means sensitive to engine temperature, and control means coupled to said inputs and resistor means for producing pulses for driving said pulse motor to move the choke valve in one direction from the engine starting position to the position at which completed engine firing is obtained, said pulses being produced by said circuit at a frequency and for a time period in accordance with the variable resistance of the resistor means whereby the choke valve is driven at a rate of speed and for a time interval related to engine temperature.

2. The improvement as claimed in claim 1 wherein said control means comprises a pulse circuit which controls the drive of the pulse motor, said pulse circuit being operated by said electrical circuit and including a pulse generator, said variable resistor means comprising a first variable resistor sensitive to temperature coupled to said pulse generator to produce an output signal with a frequency corresponding to engine temperature to drive the pulse motor at a rate of speed corresponding to said frequency.

3. The improvement as claimed in claim 2 wherein said control means comprises an AND circuit.

4. The improvement as claimed in claim 3 wherein said AND circuit has three inputs two of which are connected to said first and second inputs, said variable resistor means comprising a second variable resistor sensitive to engine temperature, said control means further comprising a timer connected to and controlled by said second variable resistor, said timer being connected to the third input of said AND circuit.

5. The improvement as claimed in claim 4 wherein said timer has an input connected to said second input sensitive to the beginning of completed engine firing.

6. The improvement as claimed in claim 4 wherein said control means further comprises a second AND circuit having one input connected to the output of said AND circuit and a second input to which said pulse generator is connected.

* * * * *